US012736315B2

(12) United States Patent
Brandly et al.

(10) Patent No.: US 12,736,315 B2
(45) **Date of Patent: *Sep. 15, 2026**

(54) JACKETED PROJECTILE AND METHOD OF MANUFACTURE

(71) Applicant: DSG Technology AS, Drammen (NO)

(72) Inventors: Raymond Dean Brandly, Fort Myers, FL (US); Tyler Charles Imig, Kalispell, MT (US); Steven R. Price, II, McKinney, TX (US); Gordon Allen Shaw, II, Mobile, AL (US); William Edward Bowie, New Windsor, MD (US); Dale Robert Dixon, Manchester, MD (US); Michael Keith Frank, Littlestown, PA (US); Blake Ashton Meyer, Loveland, CO (US)

(73) Assignee: DSG Technology AS

( * ) Notice: Subject to any disclaimer, the term of this patent is extended or adjusted under 35 U.S.C. 154(b) by 0 days.

This patent is subject to a terminal disclaimer.

(21) Appl. No.: 18/981,855

(22) Filed: Dec. 16, 2024

(65) Prior Publication Data

US 2025/0116493 A1 Apr. 10, 2025

Related U.S. Application Data

(63) Continuation of application No. 18/218,851, filed on Jul. 6, 2023, now Pat. No. 12,228,384.

(Continued)

(51) Int. Cl.

| | |
|---|---|
| ***F42B 12/78*** | (2006.01) |
| ***F42B 12/74*** | (2006.01) |
| ***F42B 33/00*** | (2006.01) |

(52) U.S. Cl.

CPC ..... *F42B 12/78* (2013.01); *F42B 12/74* (2013.01); *F42B 33/001* (2013.01)

(58) Field of Classification Search

CPC ..... F42B 12/78; F42B 12/76

(Continued)

(56) References Cited

U.S. PATENT DOCUMENTS

| | | | | |
|---|---|---|---|---|
| 10,386,164 | B2 | 8/2019 | Polovnev | |
| 12,228,384 | B2 * | 2/2025 | Brandly | F42B 12/74 |
| 2019/0017789 | A1 | 1/2019 | Burczynski | |
| 2021/0055086 | A1 | 2/2021 | Carbone et al. | |

FOREIGN PATENT DOCUMENTS

| | | | |
|---|---|---|---|
| CA | 2283828 | A1 | 9/1998 |
| CA | 2516893 | A1 | 2/2007 |

(Continued)

OTHER PUBLICATIONS

European Patent Office, Extended European Search Report issued in corresponding EP Application No. 23191028.2 dated Dec. 14, 2023.

(Continued)

*Primary Examiner* — Reginald S Tillman, Jr.
(74) *Attorney, Agent, or Firm* — Wood, Herron & Evans LLP

(57) ABSTRACT

Provided is small arms ammunition projectile (24) and manufacturing method having a core (10) with a longitudinal core axis, a forward portion (18), and a rearward end (14). The core (10) has a rear portion (16) with an edge (26) that may be chamfered or radiused, a first portion (28) being frustoconical, and a second portion (30) adjacent the first portion (28) being substantially cylindrical. The jacket (12) has a longitudinal axis (99) and longitudinally extending socket (45) to receive the rear portion (16) of the core (10). The socket (45) has a socket bottom (46), a first socket portion (50) being frustoconical, and a second socket portion (52) adjacent the first socket portion (50) being substantially cylindrical. The core (10) and jacket (12) are shaped such that when assembled, the frustoconical portion (28) of the core (10) is seated in the frustoconical portion (50) of the (Continued)

socket (45) of the jacket (12), respective contact surfaces (31, 41) of the second portions (30, 52) of the core (10) and jacket (12) mate together with the longitudinal core axis (98) and longitudinal jacket axis (99) being coaxial.

14 Claims, 8 Drawing Sheets

Related U.S. Application Data

(60) Provisional application No. 63/480,999, filed on Jan. 23, 2023.

(58) Field of Classification Search
USPC ..... 102/514, 439, 464
See application file for complete search history.

(56) References Cited

FOREIGN PATENT DOCUMENTS

| | | | |
|---|---|---|---|
| CA | 2554491 | C | 9/2012 |
| EP | 0279732 | A1 | 8/1988 |
| EP | 4024002 | A1 | 7/2022 |
| FR | 2537713 | A2 | 6/1984 |
| RU | 2244246 | C2 | 1/2005 |
| WO | 2006086902 | A1 | 8/2006 |
| WO | 2016076940 | A2 | 5/2016 |

OTHER PUBLICATIONS

Patent Cooperation Treaty, International Preliminary Report on Patentability, issued incorresponding PCT Application No. PCT/NO20204/050016, dated Oct. 16, 2024.

* cited by examiner

JACKETED PROJECTILE AND METHOD OF MANUFACTURE

RELATED APPLICATION

This is a continuation application claiming priority to U.S. Nonprovisional application Ser. No. 18/218,851, filed Jul. 6, 2023, which claimed priority to U.S. Provisional Application No. 63/480,999, filed Jan. 23, 2023, the entirety of which are incorporated by reference herein.

TECHNICAL FIELD

This invention relates to a jacketed ballistic projectile (bullet) for small arms cartridges and method of assembling a core and jacket together.

BACKGROUND

Small arms rifle projectiles (bullets) can be formed of a solid piece of one material, such as lead, copper, or brass. Others include a core that is wrapped (or "jacketed") in a material different from the core. For example, the core could be lead and the jacket copper. Copper is relatively harder than lead and helps the bullet maintain it shape. In other examples, the core is a harder material, such as steel or tungsten, to enhance penetration and the relatively softer copper jacket allows more effective engagement with the rifling of the barrel bore. The spiral rifling imparts spin to the projectile about its longitudinal central axis as it passes through the barrel, which helps stabilize the projectile during flight.

Some projectiles have cores that are fully jacketed (i.e., completely wrapped in the jacket material) and others are partially jacketed (i.e., partially wrapped in the jacket material) with a portion of the core remaining exposed. Partial jackets may cover the nose end and some or all of the periphery of the core, with the tail end left open exposing the core. Or partial jackets may cover the tail end and some or all of the periphery of the core, with the nose end left open. In either case, the jacket is generally positioned to engage the rifling rather than the core doing so.

One method of assembling a core and jacket into a complete bullet assembly is to form each component separately and then axially insert the core into an open end of the jacket and then lock the parts together, such as by swaging. Because the assembled projectile spins about a central axis in flight, any inconsistency in concentricity between the two components that shifts its center of mass off the central axis can destabilize the bullet in flight. The higher the velocity and/or spin rate of the projectile, the greater the effect of any asymmetry or non-concentricity.

The invention aims at solving at least one of the problems associated with the prior art solutions.

SUMMARY OF THE INVENTION

The invention is defined by the independent claims. The dependent claims defined advantageous embodiments.

The present invention provides a shape and method of assembling a projectile core and jacket to ensure concentric alignment. The portion of the core inserted into the jacket and the socket of the jacket each have a frustoconical shape, each having a predefined angle relative to the longitudinal axis. This shape facilitates concentric alignment of and locking the components together as they are being assembled.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
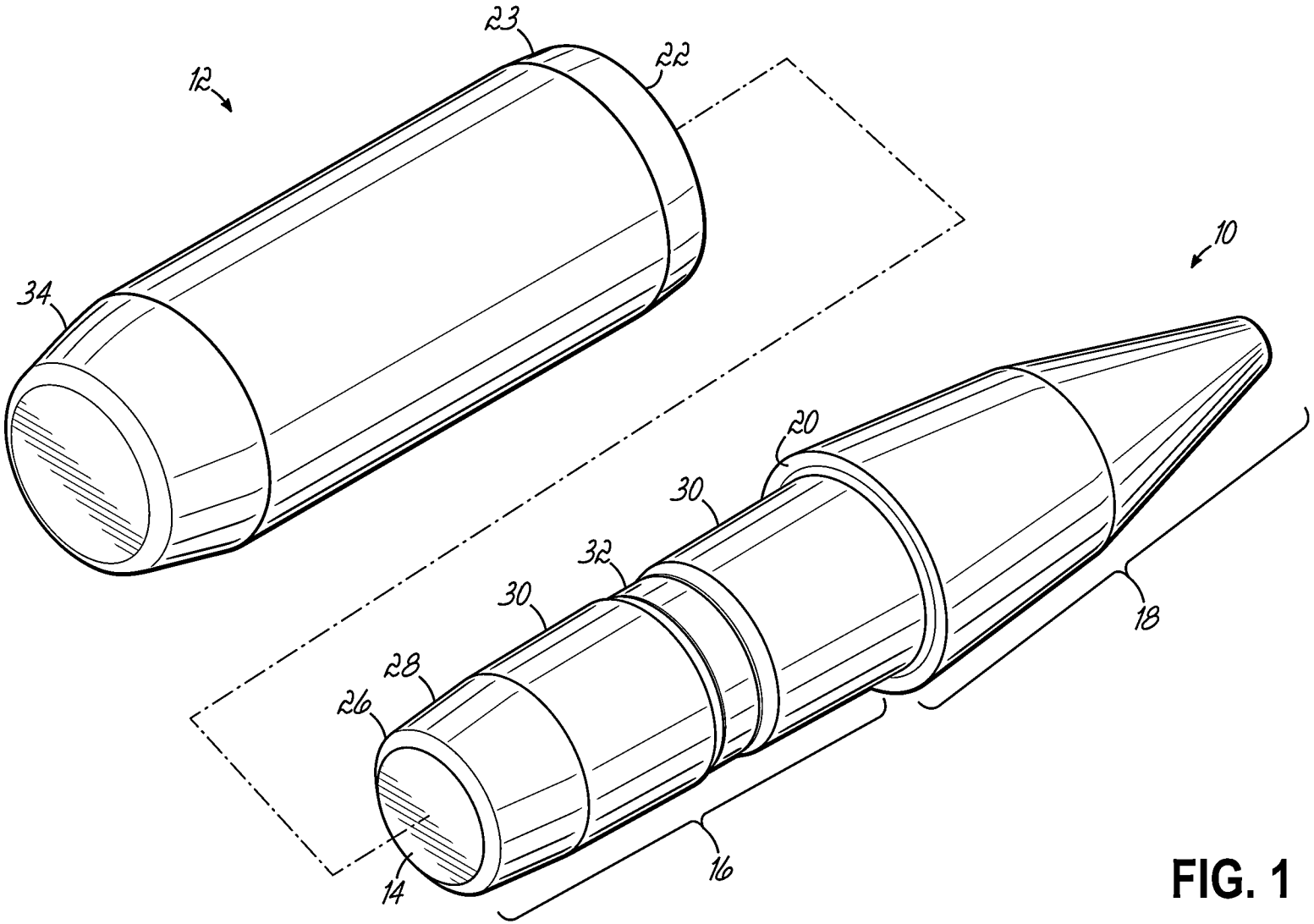
FIG. 1 is an isometric exploded view of a core and jacket according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the firearm muzzle and the direction in which projectiles are fired and travel, while "rearward" will indicate the opposite direction. "Lateral" or "transverse" indicates a side-to-side direction generally perpendicular to the axis of the barrel. "Radial" indicates a direction outward from a longitudinal center axis of the projectile. As used herein, "substantially cylindrical" means a shape that is cylindrical or nearly cylindrical (only slightly tapered). Although the present invention can be used in many forms, it is particularly suited for jacketing the rear portion of a tungsten or steel core penetrating projectile.

Figure 2:
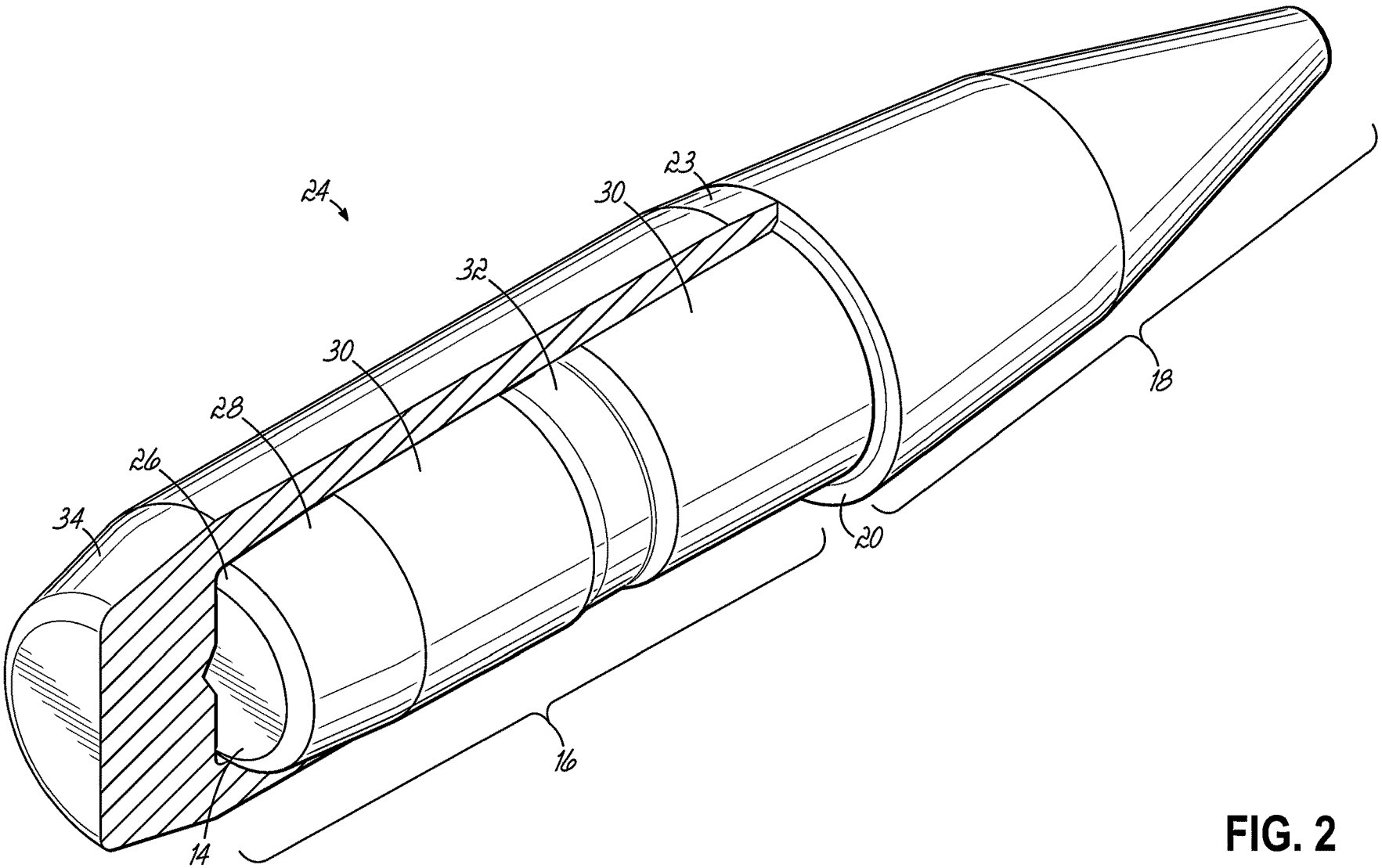
FIG. 2 is a partially cut-away isometric view showing the jacket assembled on the core.

Referring first to FIGS. 1 and 2, therein is shown a core 10 and jacket 12 according to one embodiment of the present invention. When assembled the core 10 and jacket 12 form a small arms ammunition projectile 24. In one embodiment, the core 10 can be a relatively hard material, such as steel or, preferably, tungsten, that enhances penetration. The jacket 12 may be, for example, copper or an alloy composed substantially of copper, which is relatively softer than the core 10. In this embodiment, the jacket 12 covers the rear end 14 and a rear portion 16 of the body of the core 10, with a forward portion 18 of the core 10 left uncovered and projecting forward. The core 10 has an annular shoulder 20 against which a forward edge 22 of the jacket 12 abuts when assembled. As an example, the jacket 12 of the illustrated embodiment has a least a portion 23 of its exterior profile that matches the conical or ogive shape of the forward portion 18 of the core so that the assembled unit 24 provides a continuous, substantially uninterrupted exterior profile. In this embodiment, the annular shoulder 20 is the demarcation between the rear portion 16 (covered portion) and forward portion 18 of the core 10. In preferred form, after crimping or swaging, there is zero allowable gap between the annular shoulder 20 of the core 10 and forward edge 22 of the jacket 12. The rear portion 16 of the core 10 is provided with an annular groove 32, which serves for crimping or swaging the core 10 and jacket 12 together. A rear end of the jacket 12 shows a frustoconical boat-tail 34, but this is not essential for the invention.

Figure 3:
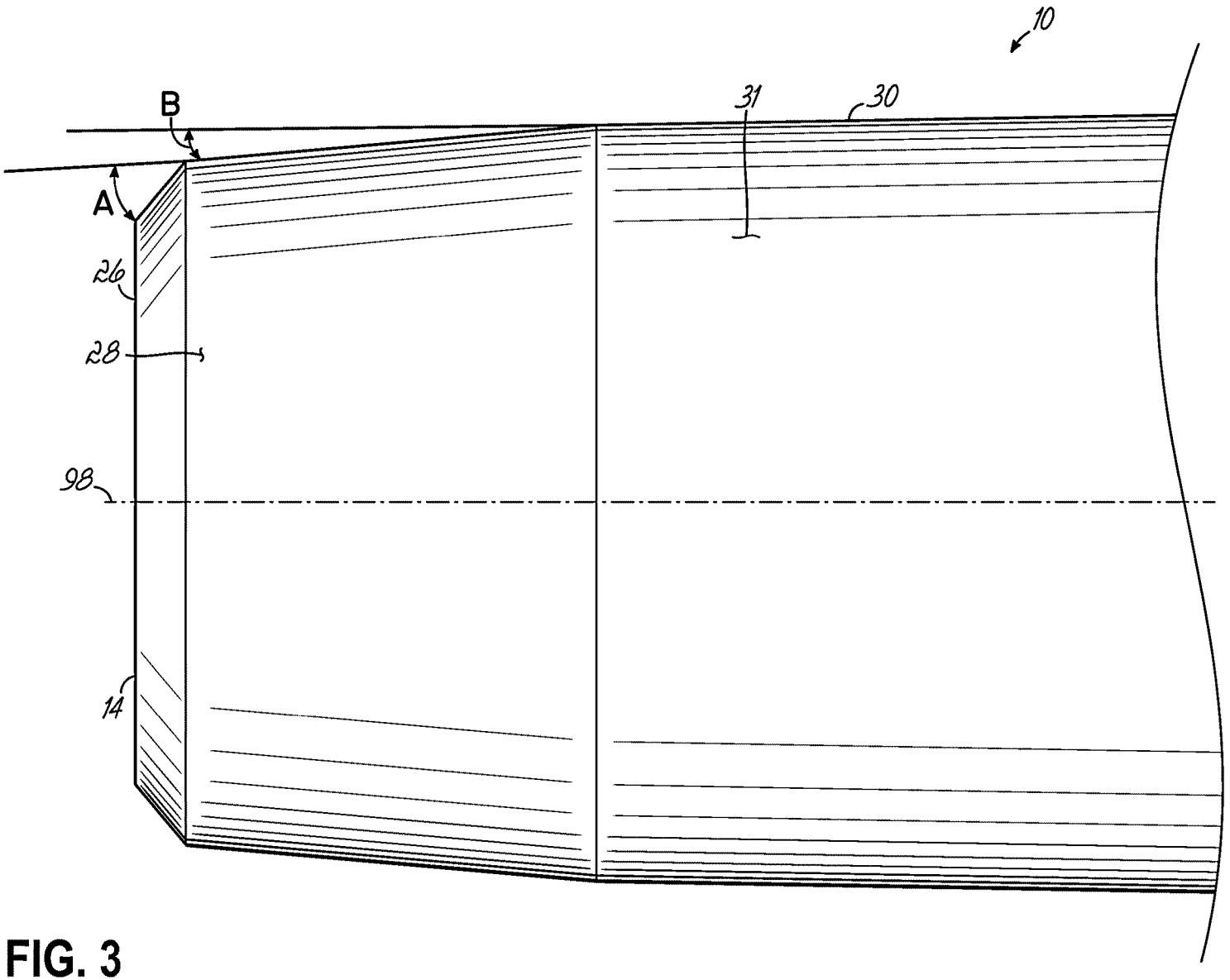
FIG. 3 is an enlarged partial side view of a rear end portion of the core.

Referring also to FIG. 3, rather than the rear portion 16 of the core 10 having an axial core direction 98 and having a cylindrical profile or a single, shallow, continuous taper (as in a prior art example), according to an embodiment of the invention, the core 10 has two portions 26, 28 at its rearmost end. The first edge portion 26 is adjacent the rear end 14. The first edge portion 26 is "eased," i.e., radiused or a relatively steep frustoconical beveled angel A such as a chamfer. For example, angle A may be about 45 degrees or an effectively similar radius of about 0.5-1.0 mm. The second, less steep and longitudinally longer frustoconical portion 28 is adjacent to and longitudinally forward of the first edge portion 26. The taper angle B of the second frustoconical portion 28 is less steep and is tapered relative to the forwardly adjacent, substantially cylindrical portion 30 of the rear portion 16 of the core 10 and may be about 5.25 degrees, +/− about 3 degrees, relative to the longitudinal axis. The surface 31 of the cylindrical portion 30 cooperates with a compliant internal surface (not shown) of the jacket 12 when inserted therein.

Figure 4:
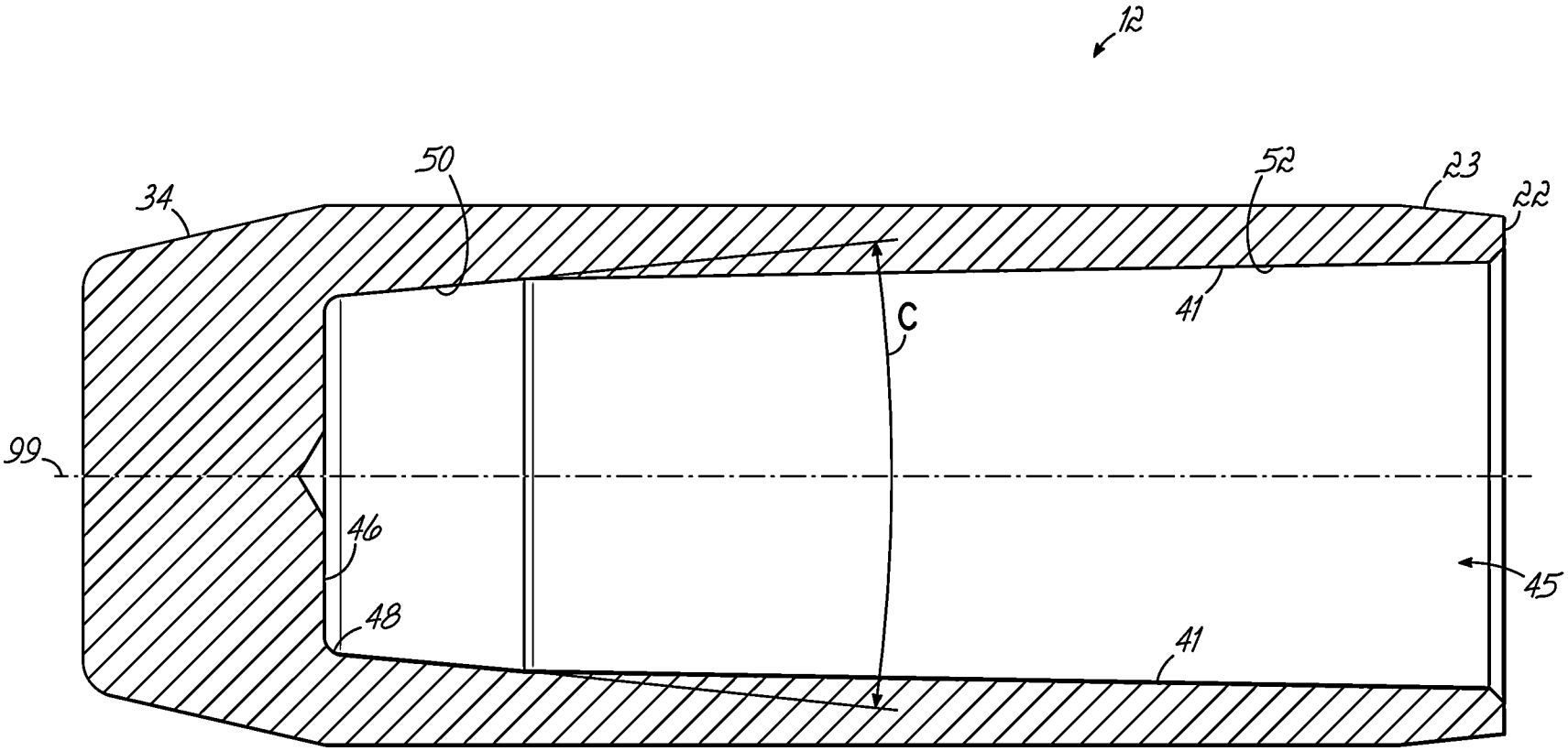
FIG. 4 is an enlarged side sectional view of the jacket showing the geometry of the interior socket.

Referring now to FIG. 4, according to another aspect of the invention, the socket 45 extending in a direction of the longitudinal axis 99 of the jacket 12 has sidewalls (forming a contact surface 41 with the core 10 when inserted) that substantially c24onform with the rear portion 16 of the rear portion of the core 10. The socket 45 has a substantially flat bottom/rear wall 46 with an annular edge 48 having a radius of up to about 0.5 mm where the bottom wall 46 meets the sidewall. The sidewall includes at least two portions. A first, rearmost portion 50 is frustoconical, where the double-angle C may be about 10.5 degrees leading to an effective angle of 5.25 degrees similar to the angle B of the core 10, to closely engage with the frustoconical portion 28 of the core 10. A second, forwardly adjacent portion 52 is substantially cylindrical to receive the substantially cylindrical portion 30 of the rear portion 16 of the core 12. The earlier-mentioned conical boat-tail 34 is also illustrated in FIG. 4.

Figure 5:
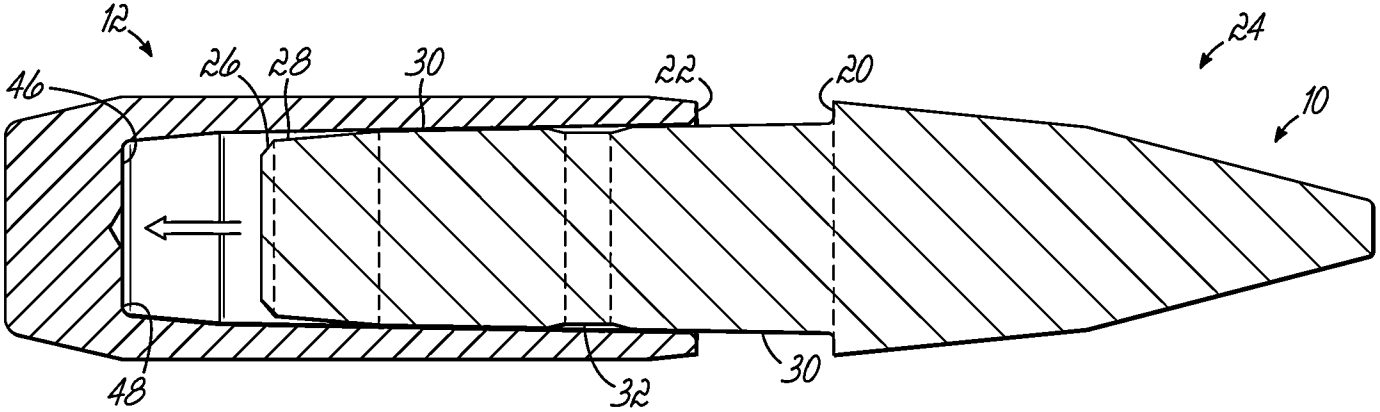
FIG. 5 is a side longitudinal sectional view showing the core being assembled into the jacket.
Figure 6:
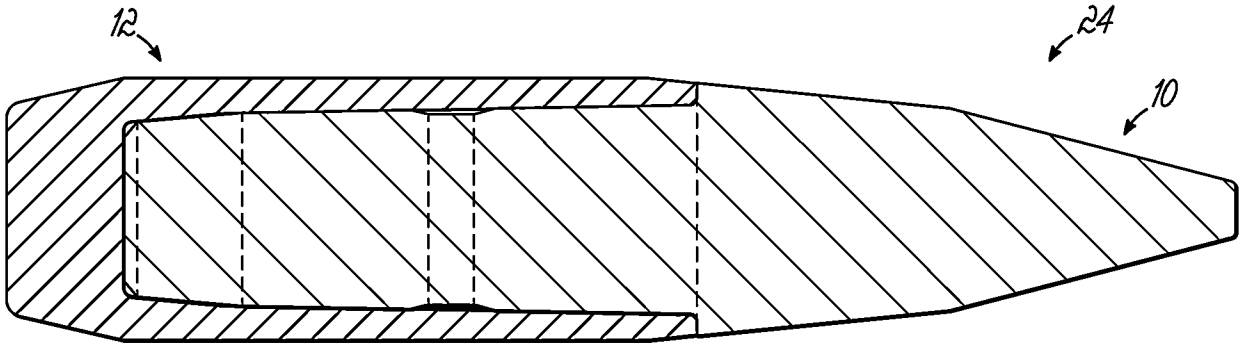
FIG. 6 is a side longitudinal sectional view showing the core assembled into the jacket.

Referring now to FIG. 5, as the core 10 is inserted into the socket of the jacket 12 (or the jacket 12 is pressed onto the core 10), the edge 26 and second frustoconical portion 28 provide the leading surfaces to interface the interior of the socket 45, causing the two components 10, 12 to maintain concentricity throughout the assembly process and to avoid gouging or otherwise displacing material from an interior socket surface 41 of the jacket 12. The jacket socket interior profile can closely match the profile of the core to fit tightly, or it can be slightly undersized to stretch circumferentially slightly as the components 10, 12 are assembled. As illustrated in FIG. 6, the core 10 and jacket 12 become fully seated together to form an assembled unit 24. As shown in FIG. 5, the leading beveled/chamfered or radiused edge 26 and frustoconical part of the core 10 are not sliding against the inside walls 50, 52 of the jacket 12 while the parts 10, 12 are moved together. As the respective frustoconical portions 28, 50 of the core 10 and jacket 12 come together, the parts are guided into concentric axial alignment.

Figure 7:
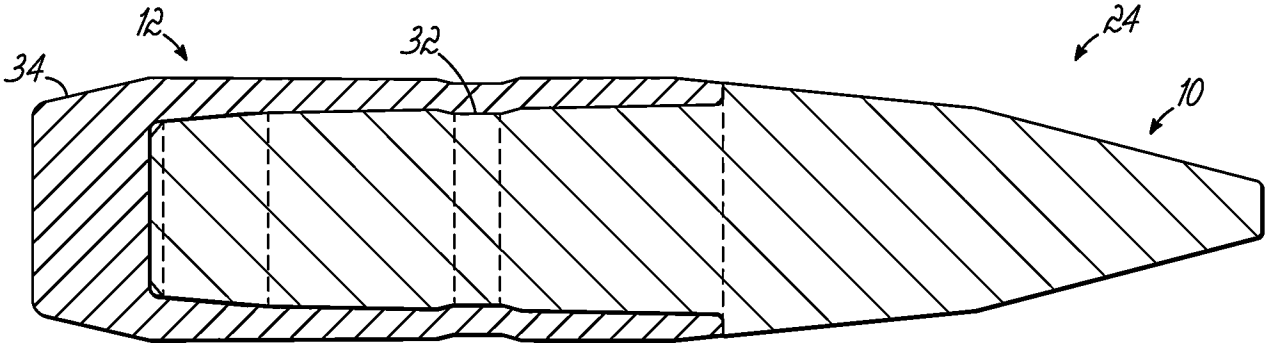
FIG. 7 is a similar view showing one way the jacket can be swaged or crimped onto the core.

The components 10, 12 can be crimped together in a well-known manner after initial assembly. Optionally, the rear portion 16 of the core 10 can include an annular groove 32 and the jacket 12 can be swaged into the groove 32 in the body of the core 10, as depicted in FIG. 7. In some cases, this may provide a gas check feature as the projectile passes through the barrel.

Figure 8:
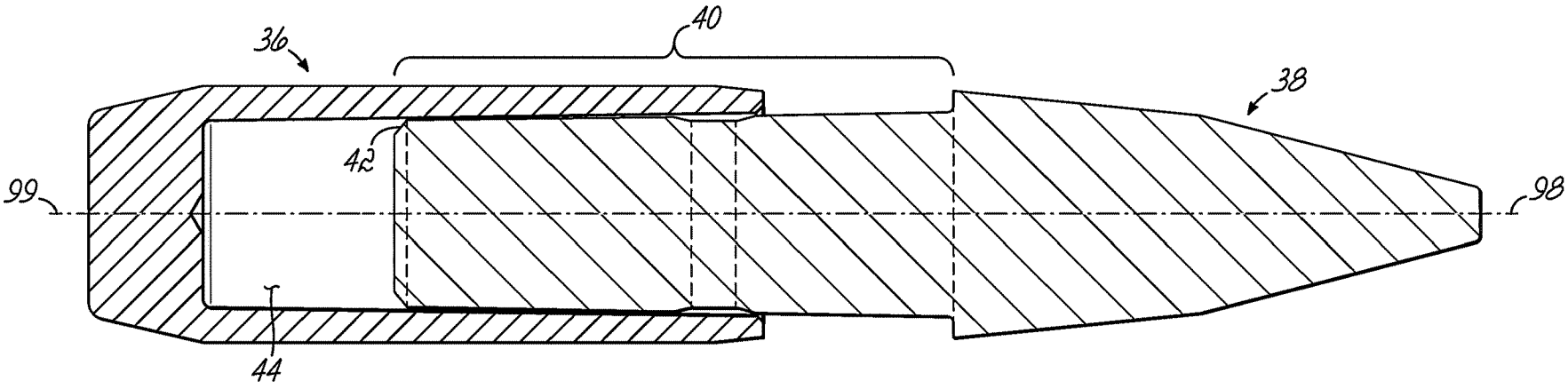
FIG. 8 PRIOR ART
FIG. 8 is a schematic side sectional view of a prior art jacket and core being assembled.
Figure 9:
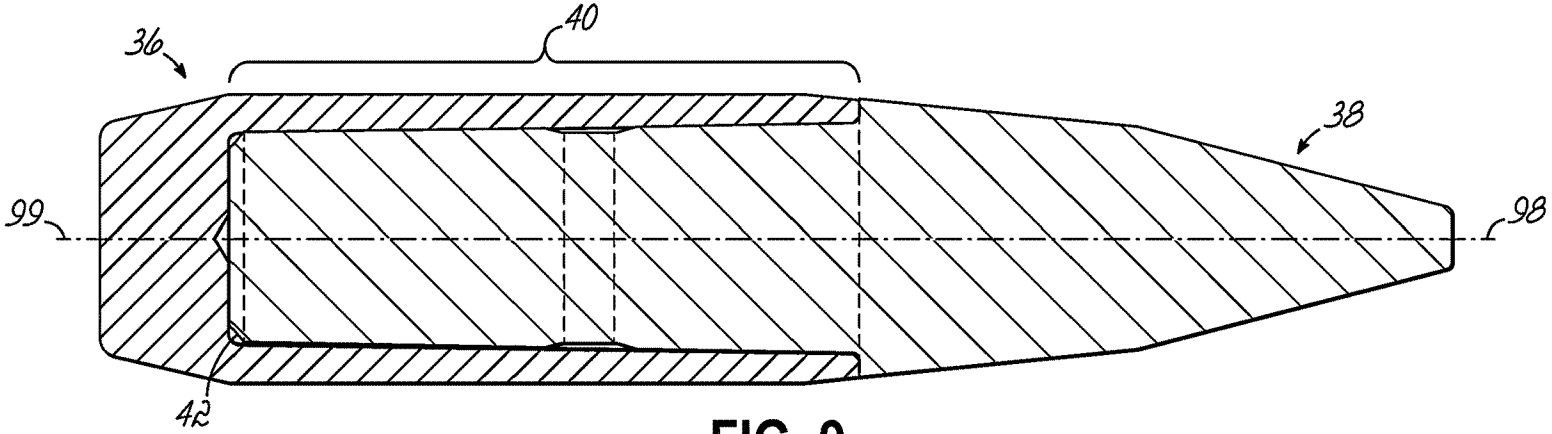
FIG. 9 PRIOR ART
FIG. 9 is a similar view of a prior art jacket and core assembled.
Figure 10:
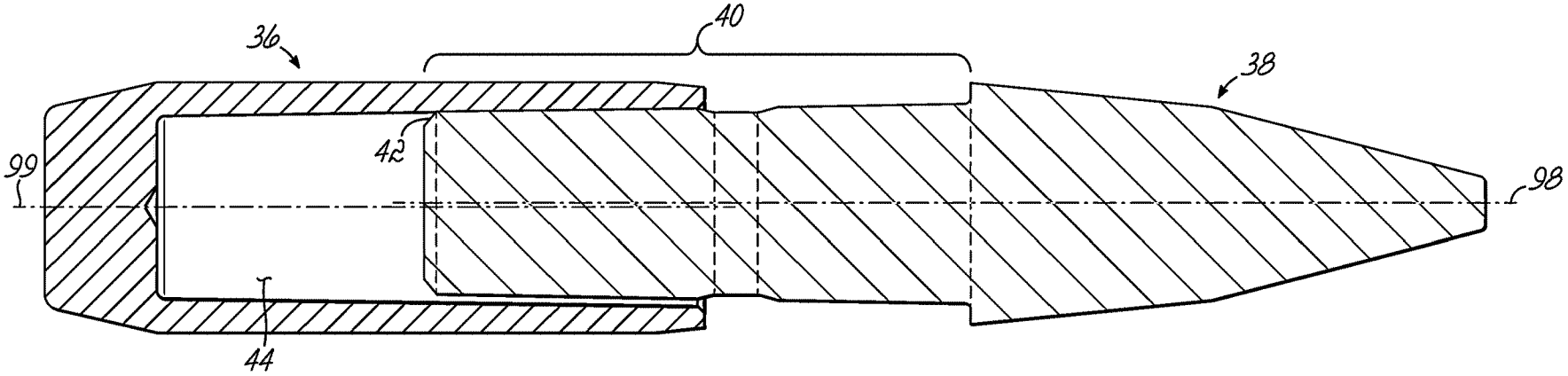
FIG. 10 PRIOR ART
FIG. 10 is a similar view of a prior art jacket and core being assembled in a non-concentric way.
Figure 11:
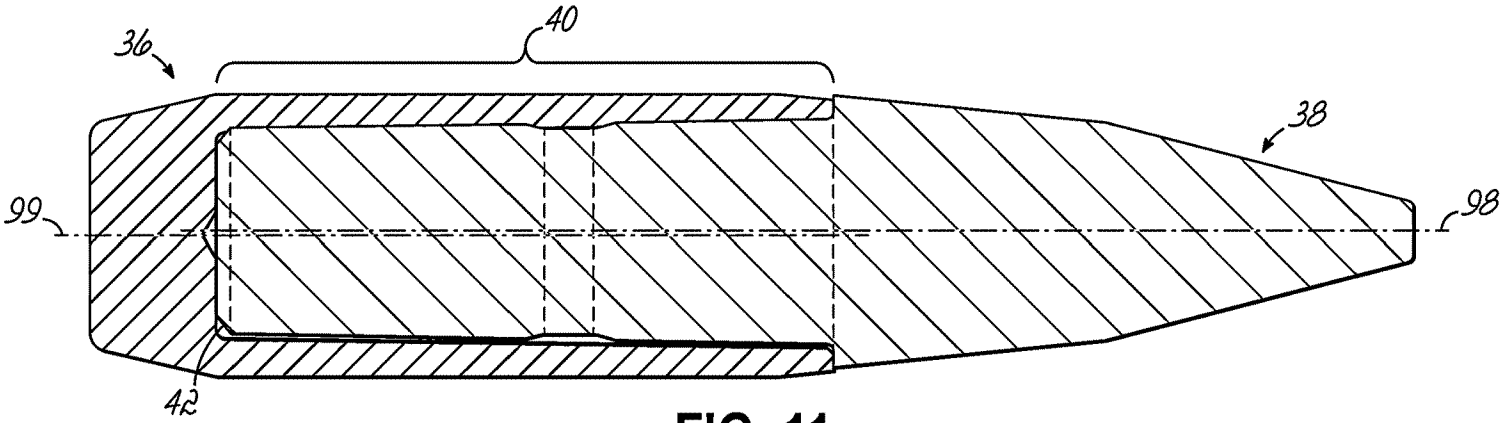
FIG. 11 PRIOR ART
FIG. 11 is a similar view of a prior art jacket and core assembled in a non-concentric way

Referring now to FIGS. 8 and 9, there is an example prior art jacket/core 36, 38 being assembled and assembled, respectively. The cover portion 40 of the prior art core 38 is substantially cylindrical with only very minor taper, if any. A small radius or chamfer may be provided at the rear edge 42 of the cover portion 40 of the core 38. When the core 38 and jacket 36 are exactly coaxially aligned during assembly (shown in FIG. 8), the resulting assembly is substantially concentric (FIG. 9). But, as shown in FIGS. 10 and 11, when the parts are nonconcentric and/or axially askew during assembly (exaggerated for illustration in FIG. 10), the edge 42 of the relatively harder core can deform the interior wall 44 of the socket inside the jacket 36 as they are pushed together. Likewise, the rear end portion of a relatively softer core 38 could be deformed. Either situation results in an assembly (exaggerated for illustration in FIG. 11) in which the core 38 and jacket 36 are nonconcentric and/or axially misaligned.

Figure 12:
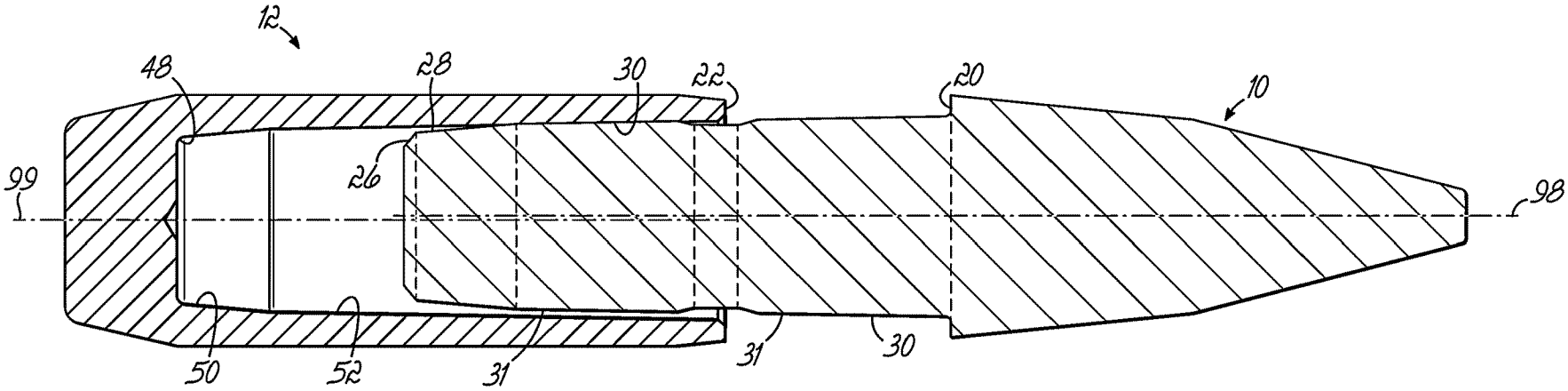
FIG. 12 is a schematic side sectional view of an embodiment of the present invention jacket and core being assembled in a non-concentric way.
Figure 13:
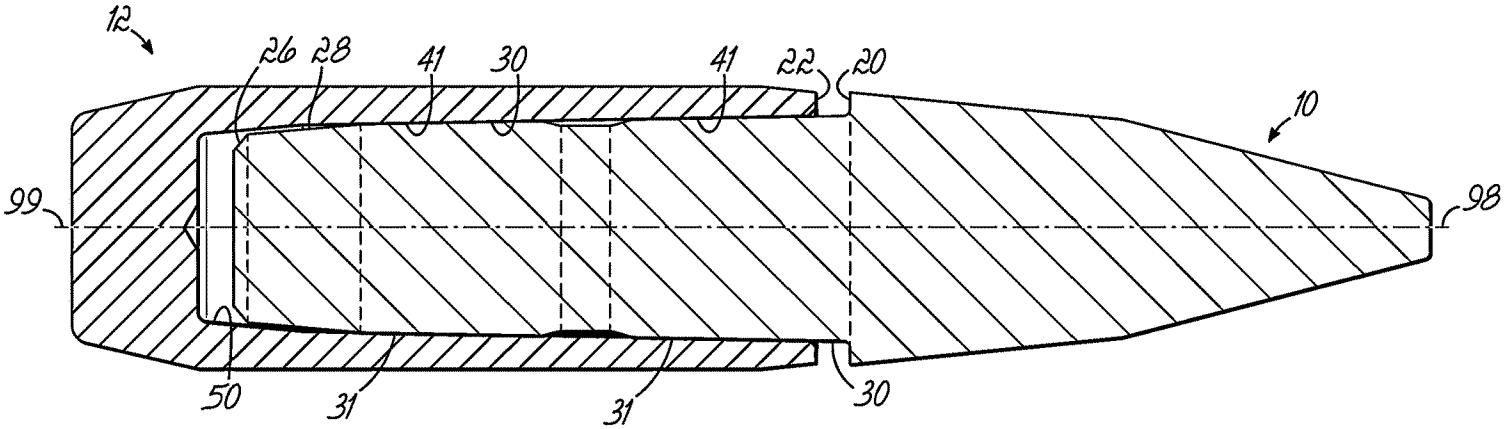
FIG. 13 is a similar view of a prior art jacket and core assembled where the concentricity of the jacket and core have been corrected during assembly.

In contrast, when the components of the present invention are nonconcentric and/or axially askew during assembly (FIG. 12, exaggerated for illustration), the core 10 does not gouge the interior of the jacket 12 and the parts are guided toward concentricity (FIG. 13) as they are further moved together and before final seating (shown in FIG. 6). FIGS. 12 and 13 also show the earlier-mentioned annular groove 32.

Referring now to FIG. 12, therein is illustrated (exaggerated for illustration) how an initially nonconcentric or misaligned assembly of a jacket and core of an embodiment of the present invention avoids deformation and guides the components into alignment and concentricity. The chamfered/radiused edge 26 and frustoconical portion 28 of the core 10 should not contact the interior wall of the jacket socket during assembly until the two parts 10, 12 are fully assembled. If the parts 10, 12 are grossly misaligned and such contact occurs, the angle of contact is such that the surfaces 31, 41 slide without damage or displacement of material and are guided toward concentricity. As the frustoconical portion 28 of the core 10 reaches engagement with the frustoconical portion 50 of the jacket socket, the components 10, 12 are guided together to seat in coaxial alignment (FIG. 13).

The exterior profile of the assembled unit 24 can be selected for it's the intended purpose of the projectile and is not critical to or limiting of the present invention. The exterior profile of the jacket 12 can, for example, include the boat-tail 34 at the rear, which affects its aerodynamic performance but does not need to correspond to the shape or position of the jacketed portion 16 of the core 10.

The present invention provides a method of assembly that assures concentricity of a projectile jacket and core. The method includes providing a core and jacket as described above and moving them together such that any axial misalignment or eccentricity (non-concentricity) is self-corrected without damage to either component and is corrected upon final seating of the parts together.

While one or more embodiments of the present invention have been described in detail, it should be apparent that modifications and variations thereto are possible, all of which fall within the true spirit and scope of the invention. For example, the principles of the present invention are readily adaptable to an embodiment in which the portion of the core that is covered is the forward portion of the projectile. Therefore, the foregoing is intended only to be illustrative of the principles of the invention in specific embodiments. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A small arms ammunition projectile made from a core and a jacket, comprising:

the core having a longitudinal core axis, a forward portion, a rear portion and a rear end, the rear portion having an edge, a first portion adjacent the edge, the first portion being frustoconical and the edge being steeper in angle than the frustoconical first portion, and the rear portion further having a second portion oppositely adjacent the first portion;

the jacket having a longitudinal axis and a socket extending in a direction of the longitudinal axis to receive the rear portion of the core, the socket having a socket bottom, a first socket portion, the first socket portion being frustoconical, and the socket having a second socket portion adjacent the first socket portion; and wherein the core and the jacket are shaped such that when assembled together, the first portion of the core is seated in the first socket portion of the socket, and respective contact surfaces of the second portions of the core and the jacket mate together with the longitudinal core axis of the core and longitudinal jacket axis of the jacket being coaxial.

2. The projectile of claim 1, wherein the core includes an uncovered portion being the forward portion.

3. The projectile of claim 2, wherein the rear portion is a rear part of the core, such that the edge is the rearmost part of the core, the first portion is forwardly adjacent the edge, and the second portion is forwardly adjacent the first portion.

4. The projectile of claim 1, wherein the first portions of the jacket and the core have substantially matching surface angles relative to their respective longitudinal axes.

5. The projectile of claim 4, wherein the first portions have surface angles in the range between about 4 degrees and about 6 degrees relative to their respective longitudinal axes, and preferably in the range between about 4.5 degrees and about 5.5 degrees, and even more preferably in the range between about 5.0 degrees and about 5.5 degrees.

6. The projectile of claim 5, wherein the first portions have surface angles of about 5.25 degrees relative to their respective longitudinal axes.

7. The projectile of claim 1, wherein the edge of the core is chamfered at an angle of about 45 degrees relative to the longitudinal axis.

8. The projectile of claim 1, wherein the edge of the core is radiused with a radius of 0.5 mm to 1.0 mm.

9. The projectile of claim 1, wherein the core is comprised substantially of a material harder than the jacket, such as steel or tungsten.

10. The projectile of claim 1, wherein the jacket is comprised substantially of copper or a copper alloy.

11. A method of assembling a small arms ammunition projectile made from a core and a jacket, the steps comprising:

providing the core having a longitudinal core axis, a forward portion, a rear portion and a rear end, the rear portion having an edge, a first portion adjacent the edge, the first portion being frustoconical and the edge being steeper in angle than the frustoconical first portion, and the rear portion further having a second portion oppositely adjacent the first portion;

providing the jacket having a longitudinal axis and a socket extending in a direction of the longitudinal axis to receive the rear portion of the core, the socket having a socket bottom, a first socket portion, the first socket portion being frustoconical, and the socket having a second socket portion adjacent the first socket portion, wherein the core and jacket are shaped such that when assembled together, the first portion of the core is seated in the first socket portion of the socket, and respective contact surfaces of the second portion of the core and the second jacket portion of the socket mate together with the longitudinal core axis of the core and longitudinal axis of the jacket being coaxial;

moving the rear portion of the core into the socket leading with the edge and first portion of the core; and continuing to move the core and jacket together until the rear end of the core seats against the socket bottom of the jacket, and the first portion of the core seats into the first socket portion of the jacket, and the second portion of the core is engaged by the second socket portion of the jacket.

12. The method of claim 11, further comprising crimping or swaging the core and jacket together.

13. The method of claim 12, wherein the rear portion of the core includes an annular groove located forward of the second portion of the core, and the jacket is swaged or crimped into the annular groove.

14. The projectile of claim 1, wherein the rear portion of the core includes an annular groove into which the jacket is swaged or crimped when assembled, the annular groove being forward of the second portion of the core.

* * * * *